US005905330A

United States Patent [19]

Imura

[11] Patent Number: 5,905,330

[45] Date of Patent: May 18, 1999

[54] FIELD EMISSION CATHODE WITH UNIFORM EMISSION

[75] Inventor: Hironori Imura, Tokyo, Japan

[73] Assignee: NEC Corporation, Tokyo, Japan

[21] Appl. No.: 08/937,737

[22] Filed: Sep. 25, 1997

Related U.S. Application Data

[63] Continuation of application No. 08/590,761, Jan. 24, 1996, abandoned.

[30] Foreign Application Priority Data

Jan. 25, 1995 [JP] Japan ..... 7-009839

[51] Int. Cl.[6] ..... H01J 1/30; H01J 19/24

[52] U.S. Cl. ..... 313/336; 313/309; 313/351; 315/169.1

[58] Field of Search ..... 313/309, 336, 313/351, 495; 315/169.1, 169.3, 169.4; 445/24; 257/752

[56] References Cited

U.S. PATENT DOCUMENTS

| | | | |
|---|---|---|---|
| 3,771,026 | 11/1973 | Asai et al. | 257/752 |
| 4,074,304 | 2/1978 | Shiba | 257/752 |
| 5,075,595 | 12/1991 | Kane | 315/169.1 |
| 5,283,500 | 2/1994 | Kochanski | 315/169.3 |
| 5,557,160 | 9/1996 | Makishima et al. | 313/336 |
| 5,585,689 | 12/1996 | Imura | 313/336 |

FOREIGN PATENT DOCUMENTS

| | | | |
|---|---|---|---|
| 4-229922 | 8/1992 | Japan | H01J 1/30 |
| 4-292831 | 10/1992 | Japan | H01J 1/30 |
| 5-36345 | 2/1993 | Japan | H01J 9/02 |
| 5-47296 | 2/1993 | Japan | H01J 1/30 |
| 5-62620 | 3/1993 | Japan | H01J 31/12 |
| 5-502545 | 4/1993 | Japan | H01J 1/30 |
| 6-21150 | 3/1994 | Japan | H01J 31/15 |

OTHER PUBLICATIONS

C.A. Spindt, "A Thin–Film Field–Emission Cathode", *Journal of Applied Physics,* vol. 39, 1968, pp. 3504–3505 (no month).

*Primary Examiner*—Sandra O'Shea
*Assistant Examiner*—Michael Day
*Attorney, Agent, or Firm*—Sughrue, Mion, Zinn, Macpeak & Seas, PLLC

[57] ABSTRACT

A field emission type cold cathode includes a gate electrode (5), and insulating layer (4) disposed under the gate electrode (5), and emitter cones (7) respectively disposed in cavities penetrating through the insulating layer (4) and the gate electrode (5). The cathode includes a conductive layer (3) which is in contact with the emitter cones (7), and a second insulating layer (2) in the form of a plurality of islands and disposed between the conductive layer (3) and a substrate (1). The conductive layer (3) is electrically connected to the substrate (1) at contact regions. In a preferred embodiment, the conductive layer (3) has pocket regions (3*c*) for connecting the conductive layer (3) with the substrate (1). The pockets (3*c*) have a first conductivity, wherein the conductive layer (3) has a second conductivity in the regions that are proximate to the areas in contact with the cones (7). The second conductivity is greater than the first conductivity. The cathode of the present invention provides for uniform operation of the emitter cones (7).

7 Claims, 6 Drawing Sheets

FIELD EMISSION CATHODE WITH UNIFORM EMISSION

This is a Continuation of application Ser. No. 08/590,761, filed Jan. 24, 1996, now abandoned.

BACKGROUND OF THE INVENTION (1) Field of the Invention

The present invention relates to a cold cathode serving as a source of electron emission, and more particularly to a field emission type cold cathode for emitting electrons from tips of cones.

(2) Description of the Related Art

There is a report that, by employing a micro-machining technique used for producing fine structures and with an LSI fabrication technique, a field emission type cold cathode can be produced on silicon wafers (reported by C. A. Spindt et al in Journal of Applied Physics, Vol. 39, pp. 3504–3505, 1968). The reported process of production and the structure of the cathode are briefly explained with reference to FIGS. 1A–1D which are diagrammatic sectional views of the structure under fabrication. First, an insulating layer 4 having a thickness of 1$\mu$m and a gate electrode 5 of molybdenum are formed on a single crystal silicon. A cavity 6 having a diameter of about 1.5 $\mu$m is then formed such that it penetrates the insulating layer 4 and the gate electrode 5 (FIG. 1A). Then, by rotating the substrate 1 about a normal line which extends through the center of the substrate 1, a sacrificial layer 12 of aluminum (Al) is formed by a vacuum deposition process in a direction 70° from the normal line on the gate electrode 5 and also on a portion of the side surface of the cavity 6 (FIG. 1B).

Then, by rotating the substrate 1 about the normal line extending through the center of the substrate 1, a high-melting point metal, for instance, molybdenum (Mo), is deposited by the vacuum deposition process in the direction of the normal line. With progressive deposition of a high-melting point metal layer 13 of Mo on the gate electrode 5, the top opening of the high-melting point metal layer 13 formed on the cavity 6 is progressively reduced because Mo is also deposited on the side surface of the top opening of the high-melting point metal layer 13. During this time, Mo is also deposited on the bottom surface of the cavity 6, and the area of this deposition layer is progressively reduced in conjunction with the progressive reduction of the top opening of the high-melting point metal layer 13. When Mo is deposited until the top opening of the high-melting metal layer 13 is completely closed, a deposit formed on the bottom surface of the cavity has a conically shape (hereinafter referred to as emitter cone) 7 (FIG. 1C). After the high-melting point metal layer 13 has been formed in this way, it is removed by the lift-off process. This is performed by dissolving the sacrificial layer 12 by dipping the wafer in phosphoric acid or other such weak acid. In this way, a fine field emission type cold cathode is obtained (FIG. 1D). By applying a voltage of several tens of volts to 200 V between the substrate 1 and the gate electrode 5 for the gate electrode 5 to be a positive potential, an electric field of $10^7$ V/cm is generated at the tip of the emitter cone 7 and electrons are emitted from the tip of the emitter cone 7.

The current development is that emission currents of 100$\mu$A and greater per emitter cone have been observed, and various modified applications have been proposed. For example, attempts have been made to produce a fine structure triode switching element using the above element as a source of electrons, and a display panel using a number of above elements in a matrix array which serves as a flat light emission source for the light emission from a phosphor. In the case of a field emission type cold cathode with an array of elements, there is a technique of providing a resistive layer between the emitter cones 7 and the substrate 1 to make the operation characteristics of these elements uniform. By the insertion of a resistor, a voltage drop due to the resistor becomes large in an element that emits a large amount of electrons. In other words, with an element that emits a large amount of electrons, since the voltage at the tip of the emitter cones 7 becomes low thereby reducing the electrons to be emitted therefrom, it is possible to make the operation of the elements uniform. Also, the provision of the resistor between the emitter cones 7 and the substrate 1 has an effect of suppressing the variations in the currents emitted from the emitter cones 7.

Methods of connecting resistors to the emitter cones 7 are proposed in Japanese Patent Application Kokai Publication No. Hei 5-47296, Japanese Patent Application Kokai Publication No. Hei 5-36345 and Japanese Patent Application Kokai Publication No. Hei 4-292831. The arrangement proposed in the Japanese Patent Application Kokai Publication No. Hei 5-47296 is shown in FIG. 2. As shown, in this case, a conductive layer 3 is formed when forming the emitter cones, so that the conductive layer 3 exists as a lower portion of each emitter cone 7. The field emission type cold cathode proposed in the Japanese Patent Application Kokai Publication No. Hei 5-36345 is shown in FIG. 3. Here, each emitter cone 7 is formed from part of a silicon substrate 1 by selectively oxidizing and etching the substrate. This cold cathode, as is the case with FIG. 2 cold cathode, has a conductive layer 3 formed as a lower portion of each emitter cone 7. The arrangement proposed in the Japanese Patent Application Kokai Publication No. Hei 4-292831 is shown in FIG. 4. Here, the field emission type cold cathode is obtained by forming a power supply line layer 11 and a uniform conductive layer 3 on an insulating substrate 10 and forming emitter cones 7 in areas in which the conductive layer 3 and insulating substrate 10 are in contact with each other.

Concerning the prior art field emission type cold cathodes in which a resistive layer is provided between the substrate and the emitter, it has been proposed to form a resistive region by such means as ion implantation in a conductive substrate. Such a process, however, has a drawback that it is difficult to obtain, with satisfactory controllability and reproducibility, a resistance of 100 KΩ to 10 MΩ that is necessary for the resistive region because of limitations imposed in forming the resistive region on the constructive substrate. Another drawback is that the formation of a resistive layer occupying a required large area results in a reduction of the element integration density in correspondence to the occupied area.

A further drawback is that, where a continuous resistive layer is provided uniformly for a plurality of elements as a group, the extent of the voltage drop effect obtained by the resistive layer at a central portion is different from that obtained at an edge portion within the group, resulting in non-uniformity of loads on the elements.

SUMMARY OF THE INVENTION

An object of the invention, therefore, is to overcome the problems existing in the prior art, and to provide a field emission type cold cathode which enables the uniform operation of arrayed elements and the suppression of variation of electron emission with the lapse of time.

According to one aspect of the invention, there is provided a field emission type cold cathode comprising:

at least one emitter cone formed over a conductive substrate, said cone having a pointed tip;

a gate electrode having an opening which surrounds the cone tip;

an insulating layer disposed under the gate electrode;

a conductive layer being in contact with the cone at a bottom portion of the cone;

a second insulating layer formed with a plurality of holes and disposed between the conductive layer and the substrate; and an interconnecting means for electrically interconnecting the conducting layer and the substrate.

With the provision of the second insulating layer formed with a plurality of holes on the conductive substrate, and the conductive layer provided on the second insulating layer are arranged such that the conductive substrate and the emitter cones are electrically interconnected at the holes provided in the second insulating layer. The controllability of the resistance of the conducting layer can also be improved. In other words, the conductive layer formed on the second insulating layer is such that its resistance can be satisfactorily controlled according to its thickness, width and length and also to its impurity concentration by the ion implantation process or diffusion process.

Further, since a plurality of emitter cones are formed, the regions of the conductive layer where the cones are formed are made to be of low resistivity, and the emitter cone formation regions and the conductive substrate are electrically interconnected via the conductive layer formed on the second insulating layer, the present invention enables the resistance between each emitter cone and the substrate to be uniform.

BRIEF DESCRIPTION OF THE DRAWINGS

The above and other objects, features and advantages of the present invention will be apparent from the following description of preferred embodiments of the invention explained with reference to the accompanying drawings, in which.

PREFERRED EMBODIMENTS OF THE INVENTION

Now, preferred embodiments of the invention are explained with reference to the drawings.

Figure 8:
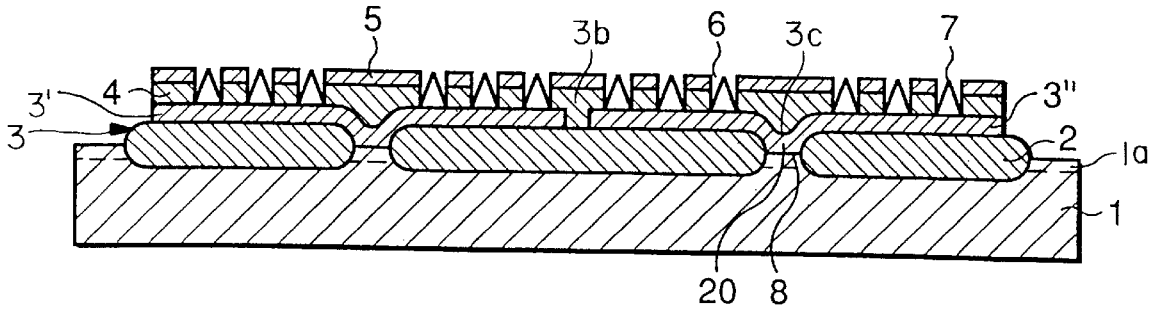
FIG. 8 is a sectional view of a field emission type cold cathode of a first embodiment according to the invention.
Figure 9:
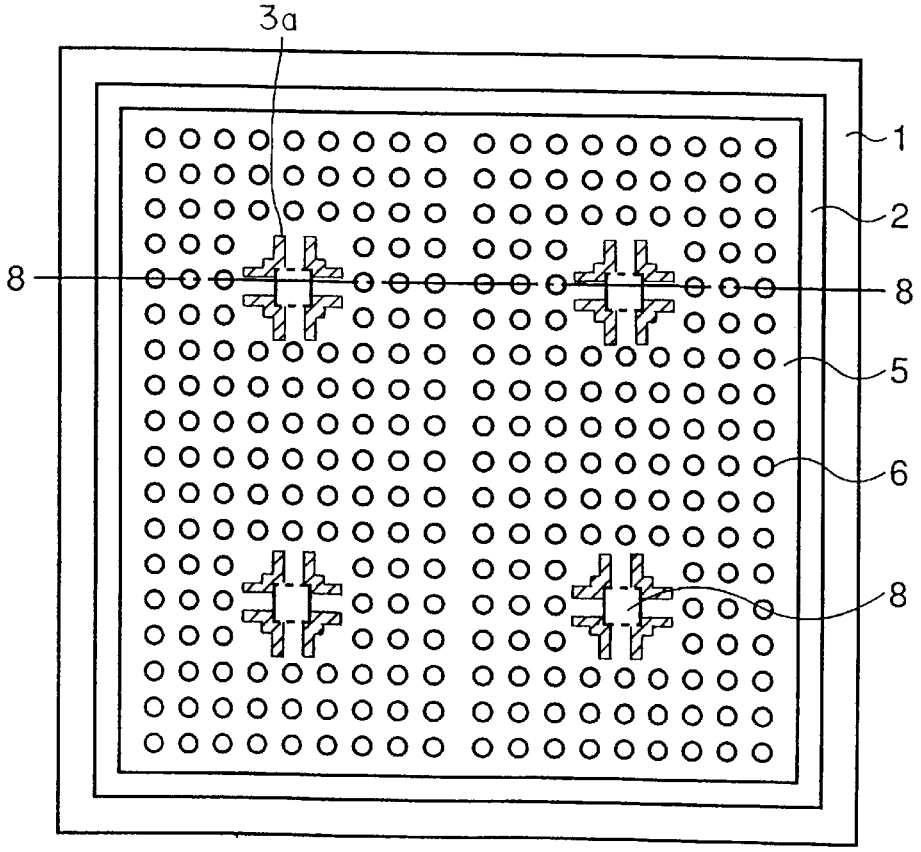
FIG. 9 is a plan view the field emission type cold cathode whose sectional view taken along line 8—8 is shown in FIG. 8.

FIG. 8 shows, in a sectional view, a field emission type cold cathode of a first embodiment according to the invention, and FIG. 9 shows the same field emission type cold cathode in its plan view. The sectional view of FIG. 8 is a view taken along line 8—8 in FIG. 9. On a conductive substrate 1 which is formed by, for instance, single crystalline silicon (Si), a second insulating layer 2 of silicon dioxide ($SiO_2$), in which square holes 20 each about 3×3 $\mu$m are provided at intervals of 50 $\mu$m in orthogonal directions. The layer is formed by a thermal oxidation process with a lithographic technique and a dry etching technique such as RIE. On the conductive substrate 1 and the second insulating layer 2, a conductive layer 3 of impurity-doped poly-silicon (poly-Si), for instance, is formed by the CVD process. On the second insulating layer 2, the conductive layer 3 is etched by the RIE technique, for instance, to form spaces 3*b*, each having a width of 1 $\mu$m. Each pocket 3*c* of the conductive layer 3 corresponds to a hole 20 of the second insulating layer 2 and each island of conductive material 3' and 3 covers a hole in the insulating layer 2 and the conductive layer 3 is electrically connected to the substrate 1 at each of the holes 20 of the second insulating layer 2. The regions at which the conductive layers 3 are electrically connected to the substrate 1 are the contact regions 8. On the conductive layer 3, an insulating layer 4 of nitride silicon ($Si_xN_y$) or oxide silicon ($Si_xO_{(1-x)}$) is formed by the CVD process. On the insulating layer 4, a gate electrode 5 of a conductive material, e.g., tungsten silicide (WSi) or tungsten (W) is formed by a sputtering process. Cylindrical cavities 6 are formed such that they penetrate through the insulating layer 4 and gate electrode 5 to a surface of the conductive layer 3. The cavities 6 are formed by a photolithographic technique and a dry etching technique such as RIE, or a wet etching technique. In each of the cavities 6, a conical emitter cone 7 of a high-melting point metal, e.g., molybdenum (Mo), or a high-melting point metal mixture is formed on the conductive layer 3 by the CVD process as already described in connection with the prior art.

With the conductive layer 3 formed on the second insulating layer 2 as above, the resistance of the conductive layer 3 can be controlled through the control of such parameters as the thickness of the layer, impurity concentration, and distance of the emitter 1cone 7 from the hole 20 of the second insulating layer.

The second insulating layer 2, when formed by the thermal oxidation process, grows into the substrate 1 for about one half of its thickness. The gate electrode 5 thus can be formed to be more planar compared to the insulating layer formed by the CVD process or the like. It is possible to form the gate electrode 5 to be further planar by using planarization techniques. With the planar gate electrode 5, the high-melting point metal layer 13 formed thereon in the same way as in the prior art described before, has improved film formation property, so that it is possible to form emitter cones 7 with a satisfactory shape.

As a modification of the first embodiment, a notch 3*a* or the like may be formed in a region extending from each contact region 8 in the conductive layer 3 to each emitter cone 7. In this way, the current path from the contact region 8 to the emitter cone 7 can be increased to further improve the resistance control property of the conductive layer 3. Particularly, by forming the second insulating layer 2 by the thermal oxidation process, it is possible not only to obtain a high quality insulating layer but also to form the gate electrode 5 to be further planar.

Another modification of the first embodiment is one in which, by using the substrate 1 having on its surface a high resistivity layer 1*a* constituted by an epitaxial layer of silicon (Si), a resistive layer is realized which is in series connection to the conductive layer 3 on the portion of the surface of the substrate 1 that is in the contact region. The resistance control of the resistive layer permits further improvement of the resistance control property between the substrate 1 and each emitter cone 7.

Figure 1A:
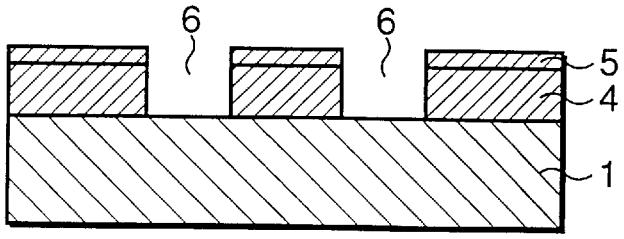
FIG. 1A PRIOR ART
FIGS. 1A–1D are sectional views of a prior art field emission type cold cathode under fabrication proposed by C. A. Spindt, et al.
Figure 1B:
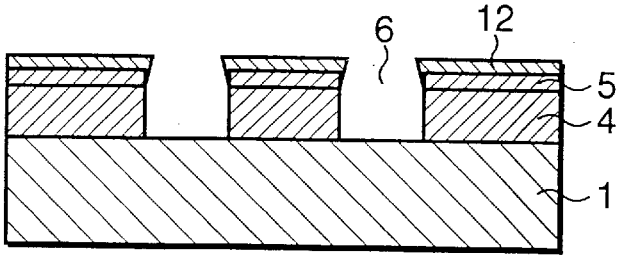
FIG. 1B PRIOR ART
Figure 1C:
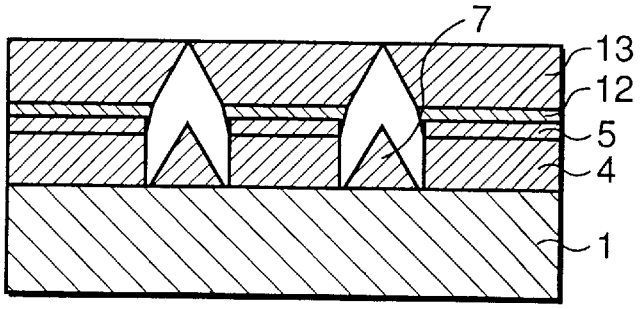
FIG. 1C PRIOR ART
Figure 1D:
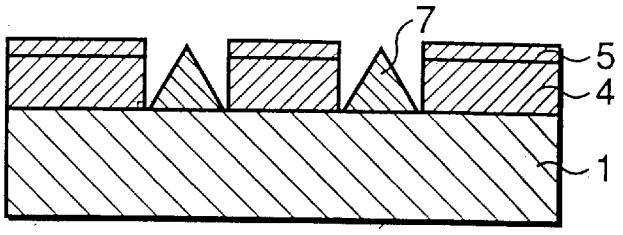
FIG. 1D PRIOR ART
Figure 2:
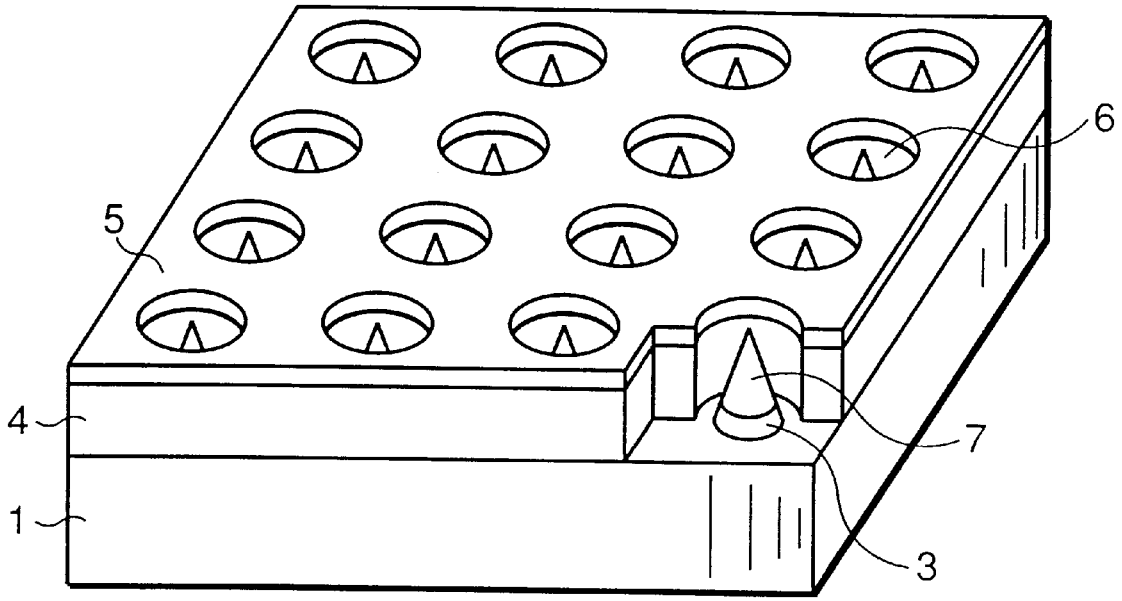
FIG. 2 PRIOR ART
FIG. 2 is a perspective view of a prior art field emission type cold cathode proposed in Japanese Patent Application Kokai Publication No. Hei 5-47296.
Figure 3:
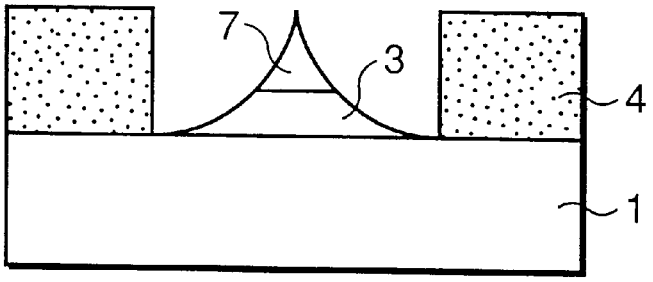
FIG. 3 PRIOR ART
FIG. 3 is a partial sectional view of a prior art field emission type cold cathode proposed in Japanese Patent Application Kokai Publication No. Hei 5-36345.
Figure 4:
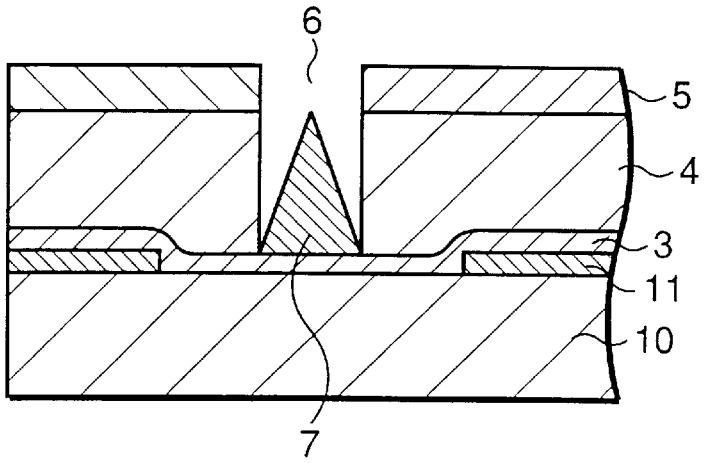
FIG. 4 PRIOR ART
FIG. 4 is a partial sectional view of a prior art field emission type cold cathode proposed in Japanese Patent Application Kokai Publication No. Hei 4-292831.
Figure 5:
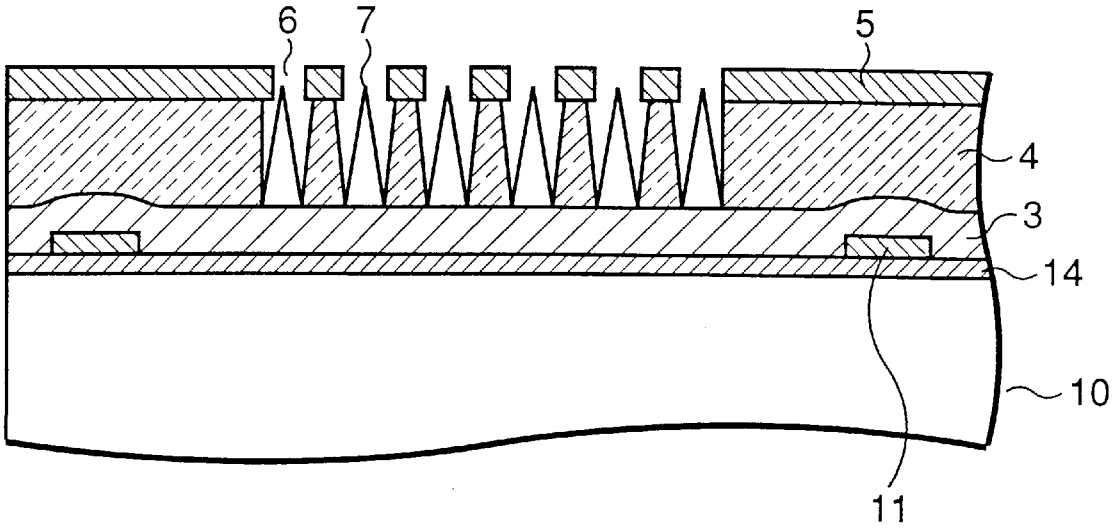
FIG. 5 PRIOR ART
FIG. 5 is a partial sectional view of a prior art field emission type cold cathode proposed in Japanese Patent Application Kokai Publication No. Hei 4-229922.
Figure 6:
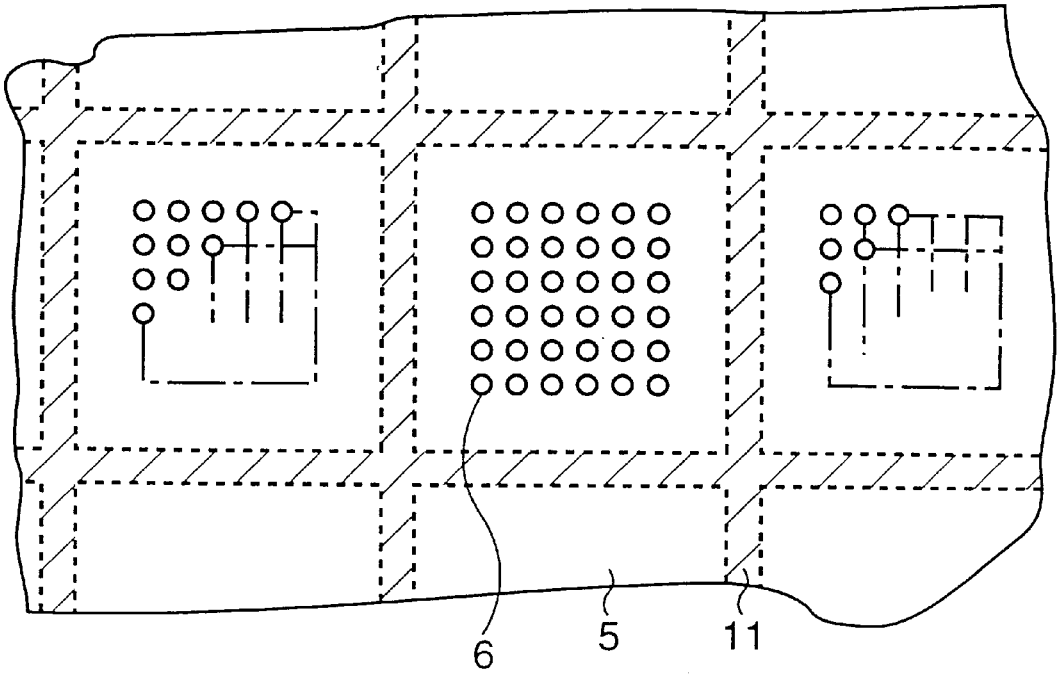
FIG. 6 PRIOR ART
FIG. 6 is a plan view of the prior art field emission type cold cathode shown in FIG. 5.

A method for forming groups of emitter cones is proposed in Japanese Patent Application Kokai Publication No. Hei 4-229922. FIGS. 5 and 6 are a sectional view and a plan view, respectively, of the proposed structure. This structure, as shown in FIG. 5, has a conductive layer 3 which is formed over the entire area of an insulating substrate 10, and thus is different from the structure according to the present invention wherein the conductive layer 3 having pockets is formed on the second insulating layer 2. In addition, the disclosed structure, as shown in FIG. 6, has power supply lines 11 formed in a crisscross fashion on the insulating substrate 10 for supplying current to the conductive layer 3. With this structure, the element integration density is reduced to an extent corresponding to the area occupied by the power supply lead lines. On the other hand, in the structure according to the present invention, each of the power supply regions, i.e., a region at which the conductive layer 3 is electrically connected to the substrate 1, is in a dot-like form. Thus, the structure has an effect of allowing a greater element integration density.

Figure 7:
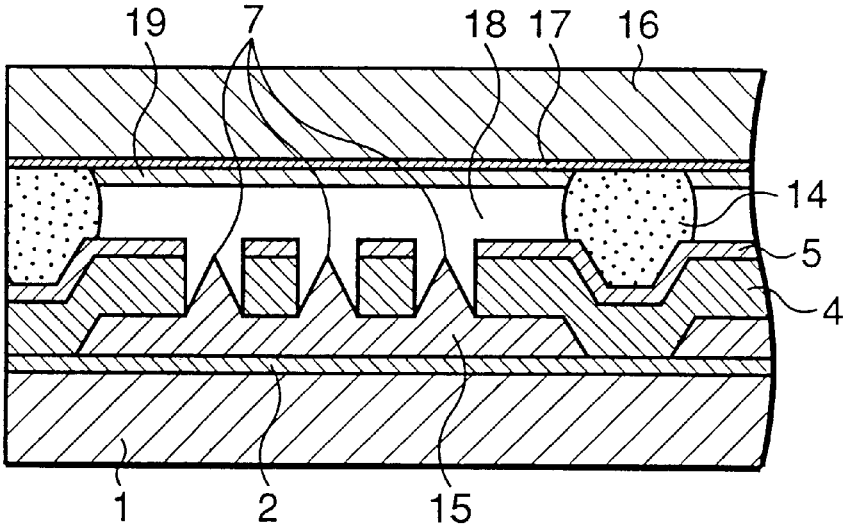
FIG. 7 PRIOR ART
FIG. 7 is a partial sectional view of a prior art field emission type cold cathode proposed in Japanese Patent Application Kokai Publication No. Hei 5-62620.

Japanese Patent Application Kokai Publication No. Hei 5-62620 shows an example of using the second insulating layer. FIG. 7 shows the example disclosed in this publication. As shown therein, in the disclosed structure, an emitter cone 7 of silicon is formed using a second silicon layer 15 formed on a second insulating layer 2 which is disposed on a substrate 1 of single crystal silicon called SOI. However, according to the disclosed method, the substrate 1 merely serves to support the structure formed on it, and no emitter voltage is applied to the substrate 1. In other words, according to the disclosed method, the second insulating layer 2 does not have any contact region 8, and the second silicon layer and the substrate 1 are insulated from each other. The disclosed arrangements are thus different in structure and purpose from the field emission type cold cathode according to the invention.

Figure 10:
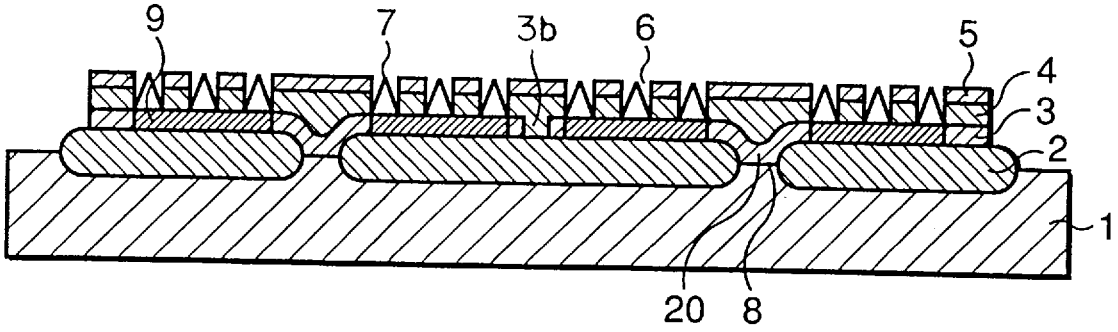
FIG. 10 is a sectional view of a field emission type cold cathode of a second embodiment according to the invention.

FIG. 10 is a sectional view showing a field emission type cold cathode of a second embodiment according to the invention. This embodiment is the same as the preceding first embodiment except that the conductive layer 3 has low resistivity regions 9 which are positioned in the vicinity of emitter cones 7. The low resistivity regions 9 may be readily formed by increasing the impurity concentration portions of the conductive layer 3 corresponding to them by means of ion implantation in the step of forming the conductive layer 3. The effect obtained by the low resistivity regions 9 is that the emission current and the voltage drop caused by the resistance of the conductive layer 3 are made uniform at individual emitter cones 7 within each group thereof.

As has been described in the foregoing, according to the invention, it is possible to form a resistive layer having desired shape and area between the emitter and the substrate due to the insulating layer and conductive layer provided between the emitter and the substrate. In addition, the resistance of the resistor connected to each emitter can be made more uniform, thus enabling a uniform element operation.

While the invention has been described in its preferred embodiments, it is to be understood that the words which have been used are words of description rather than limitation and that changes within the purview of the appended claims may be made without departing from the true scope of the invention as defined by the claims.

What is claimed is:

1. A field emission type cold cathode comprising:

a plurality of emitter cones formed over a conductive substrate;

a gate electrode which has openings surrounding said cones;

a first insulating layer which is disposed under said gate electrode;

a conductive layer, formed as islands of conductive material, each of said islands being in contact with at least one cone; and a second insulating layer, formed with a plurality of holes and disposed between said conductive layer and said substrate, such that the second insulating layer is diffused into said substrate to be partially integrated with said substrate;

wherein said substrate and said conductive layer are in physical contact with each other through the holes in said second insulating layer, wherein said conductive layer has pocket regions formed in the regions corresponding to where holes are formed in said second insulating layer for connecting said conductive layer with said substrate, said pocket regions having a first conductivity, and wherein said conductive layer has a second conductivity in the regions that are proximate to an area that is in contact with the cones, the second conductivity being greater than the first conductivity.

2. A field emission type cold cathode comprising:

a Plurality of emitter cones formed over a conductive substrate;

a gate electrode which has openings surrounding said cones;

a first insulating layer which is disposed under said gate electrode;

a conductive layer which is in contact with said cones at a bottom portion of said cones;

a second insulating layer, formed with a plurality of holes and disposed between said conductive layer and said substrate; and an interconnecting means for electrically interconnecting said conductive layer and said substrate, wherein said conductive layer includes a notch disposed about the interconnecting means.

3. The field emission type cold cathode of claim 2, wherein each of said emitter cones is spaced apart from the interconnecting means by a notch.

4. A field emission type cold cathode comprising:

a plurality of emitter cones formed over a conductive substrate;

a gate electrode which has openings surrounding said cones;

a first insulating layer which is disposed under said sate electrode;

a non-uniform conductive layer, formed as islands of conductive material, each of said islands being in contact with at least one cone; and a second insulating layer, formed with a plurality of holes and disposed between said conductive layer and said substrate, such that the second insulating layer is diffused into said substrate to be partially integrated with said substrate;

wherein said substrate and said conductive layer are in physical contact with each other through the holes in said second insulating layer, wherein said conductive layer has pocket regions formed in the regions corresponding to where holes are formed in said second insulating layer for connecting said conductive layer with said substrate, said pocket regions having a first conductivity, and wherein said conductive layer has a second conductivity in the regions that are proximate to an area that is in contact with the cones, the second conductivity being greater than the first conductivity.

5. The field emission type cold cathode according to claim 4, wherein said conductive layer has pockets formed in the regions corresponding to where said holes are formed in said second insulating layer.

6. A field emission type cold cathode comprising:

a plurality of emitter cones formed over a conductive substrate;

a gate electrode which has openings surrounding said cones;

a first insulating layer which is disposed under said gate electrode;

a non-planar conductive layer, formed as islands of conductive material, which is in contact with said cones at a bottom portion of said cones;

a second insulating layer, formed with a plurality of holes and disposed between said conductive layer and said substrate; and an interconnecting means for electrically interconnecting said conductive layer and said substrate, wherein said conductive layer includes a notch disposed about the interconnecting means.

7. The field emission type cold cathode of claim 6, wherein each of said emitter cones is spaced apart from the interconnecting means by a notch.

* * * * *